US009327293B2

(12) United States Patent
McKinney et al.

(10) Patent No.: US 9,327,293 B2
(45) Date of Patent: May 3, 2016

(54) ELECTRODE SUPPORT FOR ELECTRICALLY-ENHANCED AIR FILTRATION SYSTEM

(75) Inventors: Peter Johannes McKinney, Boulder, CO (US); Ronald L. Bowman, Golden, CO (US)

(73) Assignee: CARRIER CORPORATION, Farmington, CT (US)

( * ) Notice: Subject to any disclaimer, the term of this patent is extended or adjusted under 35 U.S.C. 154(b) by 180 days.

(21) Appl. No.: 14/119,461

(22) PCT Filed: May 14, 2012

(86) PCT No.: PCT/US2012/039300

§ 371 (c)(1), (2), (4) Date: Mar. 26, 2014

(87) PCT Pub. No.: WO2012/162476

PCT Pub. Date: Nov. 29, 2012

(65) Prior Publication Data

US 2014/0216260 A1 Aug. 7, 2014

Related U.S. Application Data

(60) Provisional application No. 61/489,533, filed on May 24, 2011.

(51) Int. Cl.

| | |
|---|---|
| ***B03C 3/00*** | (2006.01) |
| ***B03C 3/86*** | (2006.01) |
| ***B03C 3/70*** | (2006.01) |
| ***B03C 3/09*** | (2006.01) |

(Continued)

(52) U.S. Cl.

CPC ... *B03C 3/86* (2013.01); *B03C 3/09* (2013.01); *B03C 3/155* (2013.01); *B03C 3/41* (2013.01);

(Continued)

(58) Field of Classification Search

CPC ..... B03C 3/09; B03C 3/41; B03C 3/47; B03C 3/70; B03C 3/86; B03C 3/155

USPC ..... 96/58, 88; 55/493, 509

See application file for complete search history.

(56) References Cited

U.S. PATENT DOCUMENTS 4,549,887 A * 10/1985 Joannou ..... 96/58
4,634,806 A * 1/1987 Haag et al. ..... 174/211

(Continued)

FOREIGN PATENT DOCUMENTS

EP 2253381 A1 11/2010
WO 2006015503 A1 2/2006

OTHER PUBLICATIONS

U.S. Appl. No. 14/119,461, McKinney et al, Karla Hawkins.*

(Continued)

*Primary Examiner* — Jason M Greene
*Assistant Examiner* — Karla Hawkins
(74) *Attorney, Agent, or Firm* — Cantor Colburn LLP

(57) ABSTRACT

An electrode support for an electrode of an electrically-enhanced air filtration system includes a conductor extending through the electrode support and electrically connectible to the electrode and to a power supply. An insulative layer is located around the conductor and the electrode support is configured to position the electrode in a frame of the air filtration system. An air filtration system includes a frame directing an airflow through the air filtration system and an electrode located in the frame. An electrode support positions the electrode in the frame and includes a conductor extending through the electrode support and electrically connected to the electrode and an insulative layer located around the conductor. An electrical power supply is electrically connected to the conductor to provide electrical power to the electrode.

15 Claims, 5 Drawing Sheets

(51) Int. Cl.
*B03C 3/155* (2006.01)
*B03C 3/41* (2006.01)
*B03C 3/47* (2006.01)

(52) U.S. Cl.
CPC ... *B03C 3/47* (2013.01); *B03C 3/70* (2013.01); *B03C 2201/06* (2013.01); *B03C 2201/10* (2013.01)

(56) References Cited

U.S. PATENT DOCUMENTS 5,474,599 A * 12/1995 Cheney ..... B03C 3/155 95/63
2005/0160908 A1 7/2005 Kukla
2006/0150815 A1 * 7/2006 Yamada ..... 96/58

OTHER PUBLICATIONS

Notification of Transmittal of the International Preliminary Report on Patentability of the International Searching Authority PCT/US2012/039300; Nov. 26, 2013; 9 pages.

Notification of Transmittal of the International Search Report and the Written Opinion of the International Searching Authority, or the Declaration; PCT/US2012/039300; Oct. 1, 2012; 13 pages.

* cited by examiner

ELECTRODE SUPPORT FOR ELECTRICALLY-ENHANCED AIR FILTRATION SYSTEM

BACKGROUND OF THE INVENTION

The subject matter disclosed herein relates to air filtration systems. More specifically, the subject disclosure relates to supports for high voltage electrodes in electrically-enhanced air filtration systems.

In air filtration systems, for example, electrically enhanced air filtration systems, electrostatic filters installed in the systems collect impurities in an airflow through the system before the airflow is circulated through a space such as a home or other building. In such systems, high voltage electrodes, also referred to as "ionization arrays" are positioned upstream of the electrostatic filters and ionize the airflow via a high voltage flow across the ionization array. The ionization array is typically held in position in a housing or frame of the system by a number of insulating supports. Further, power is delivered to the ionization array from a high voltage power supply by a power cable connected to the ionization array. When these supporting structures and connections accumulate dirt and/or moisture or other contaminants, electrical charge can unintentionally leak from the ionization array to ground or to other system elements. Such leakage may occur over the outside of the insulation of the power cable. Leakage current may reduce the effectiveness of the system or render it inoperable, and can be a safety hazard by the introduction of high voltage and electrical current to portions of the system that were never intended to handle such conditions.

BRIEF DESCRIPTION OF THE INVENTION

According to one aspect of the invention, an electrode support for an electrode of an electrically-enhanced air filtration system includes a conductor extending through the electrode support and electrically connectible to the electrode and to a power supply. An insulative layer is located around the conductor and the electrode support is configured to position the electrode in a frame of the air filtration system.

According to another aspect of the invention, an air filtration system includes a frame directing an airflow through the air filtration system and an electrode located in the frame. An electrode support positions the electrode in the frame and includes a conductor extending through the electrode support and electrically connected to the electrode and an insulative layer located around the conductor. An electrical power supply is electrically connected to the conductor to provide electrical power to the electrode.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
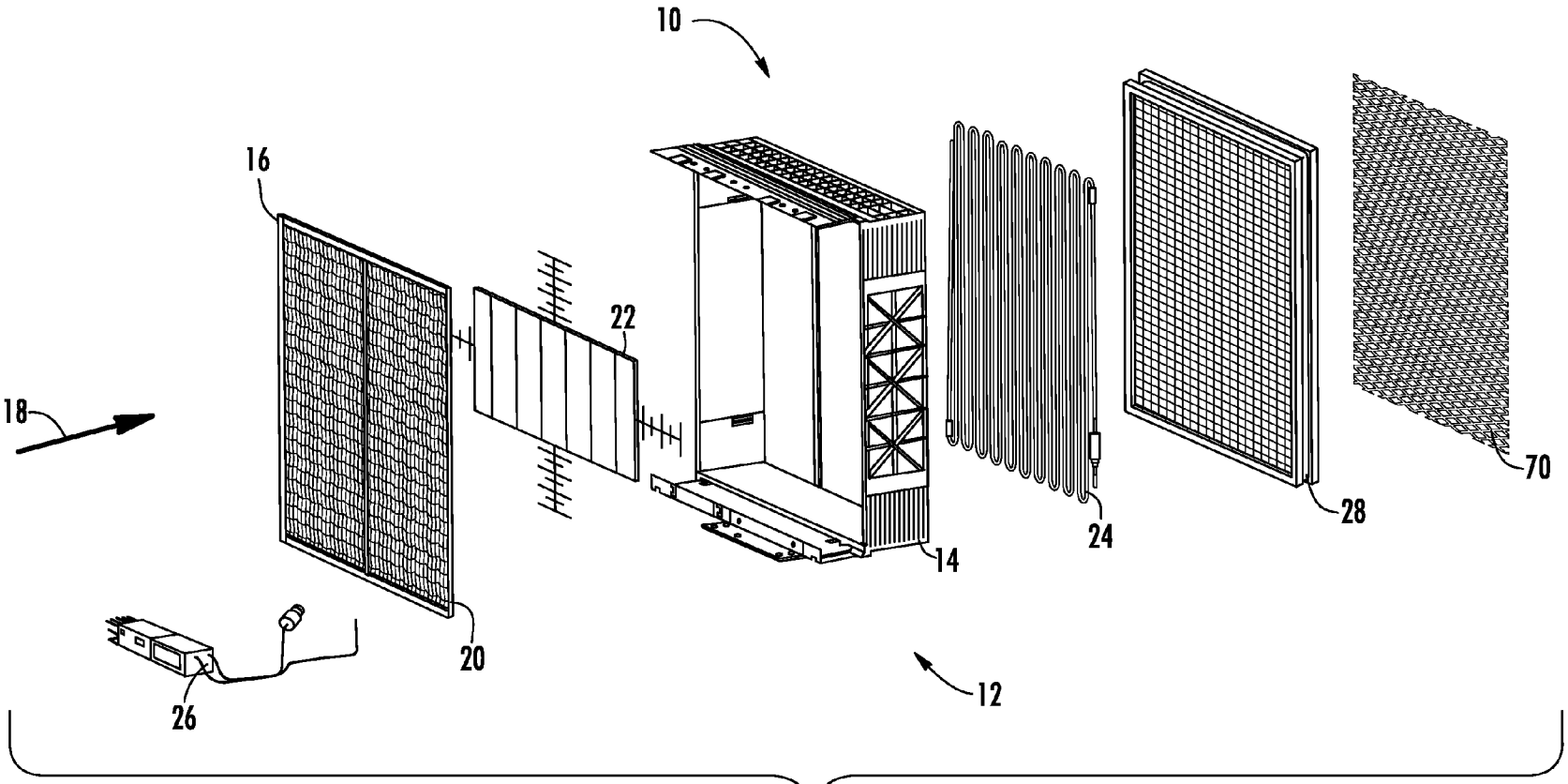
FIG. 1 schematically illustrates an embodiment of an air filtration system.

Shown in FIG. 1 is a view of an embodiment of an air filtration system 10. The air filtration system 10 of FIG. 1 is an electrically enhanced air filtration system 10, but it is to be appreciated that utilization of the present invention with other types of air filtration systems 10 having replaceable filters and/or electrodes is contemplated within the present scope.

The air filtration system 10 includes a field enhancement module (FEM) 12, shown exploded in FIG. 1. The FEM 12 includes a frame 14. The frame 14 is configured to arrange the components of the FEM 12 which are secured therein. At an upstream end 16 of the FEM 12, relative to an airflow direction 18 of air through the filtration system 10 is, in some embodiments, a safety screen 20 which may also act as an upstream ground for the FEM 12. Downstream of the safety screen 20 is an electrode, also known as an ionization array 22, and a field-generating array 24 located downstream of the ionization array 22. The ionization array 22 is an array of points sufficiently sharp such as to produce corona discharge when a pre-determined voltage is applied. For example, the ionization array may comprise a plurality of thin wires, barbed wires, or any structure capable of producing the corona needed to yield ions. The field-generating array 24 and the ionization array 22 are both connected to and powered by a high voltage power supply 26. A media filter 28 is disposed in the frame 14 downstream of the field-generating array 24. Further, some embodiments may include a downstream conductive electrode 70, which acts as a ground for the ionization array 22 and further provides a sink or drain for ionic current flowing into the media filter 28. This allows more current to flow into the filter 28 via corona discharge from the ionization array 22. It is to be appreciated that while a field-generating array 24 is included in the system 10 described herein, in some embodiments, the field generating array 24 may be omitted.

Figure 2:
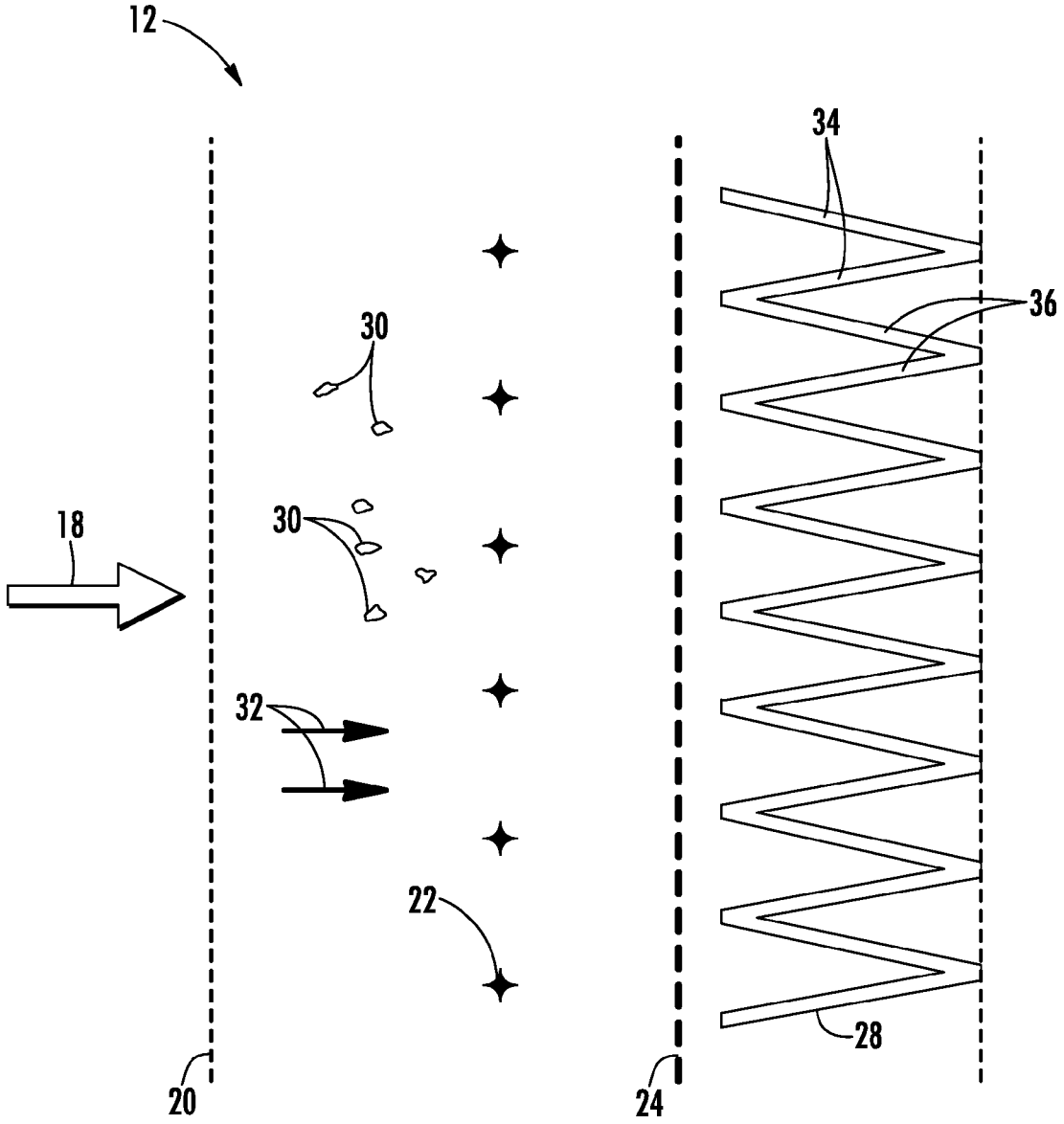
FIG. 2 is a schematic cross-sectional view of an embodiment of an air filtration system.

Referring now to FIG. 2, when the power supply 26 is activated, the ionization array 22 ionizes particles 30 in an airstream 32 passing through the FEM 12. The voltage across the field-generating array 24 polarizes media fibers 34 of the media filter 28, which causes the ionized particles 30 to be attracted to and captured by the media fibers 34. It is to be appreciated that, in some embodiments, the field-generating array is not required and the ionized gas (air) charges the filter media, which renders the fibers electrostatically attractive to the particles 30 whether they be charged or not.

Figure 3:
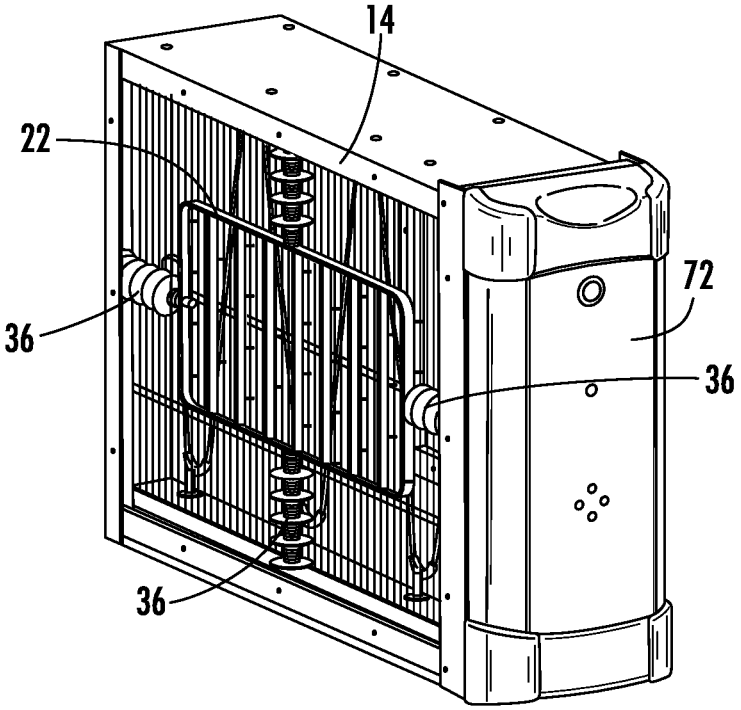
FIG. 3 is a perspective view of an embodiment of an electrode support installed in an air filtration system.
Figure 4:
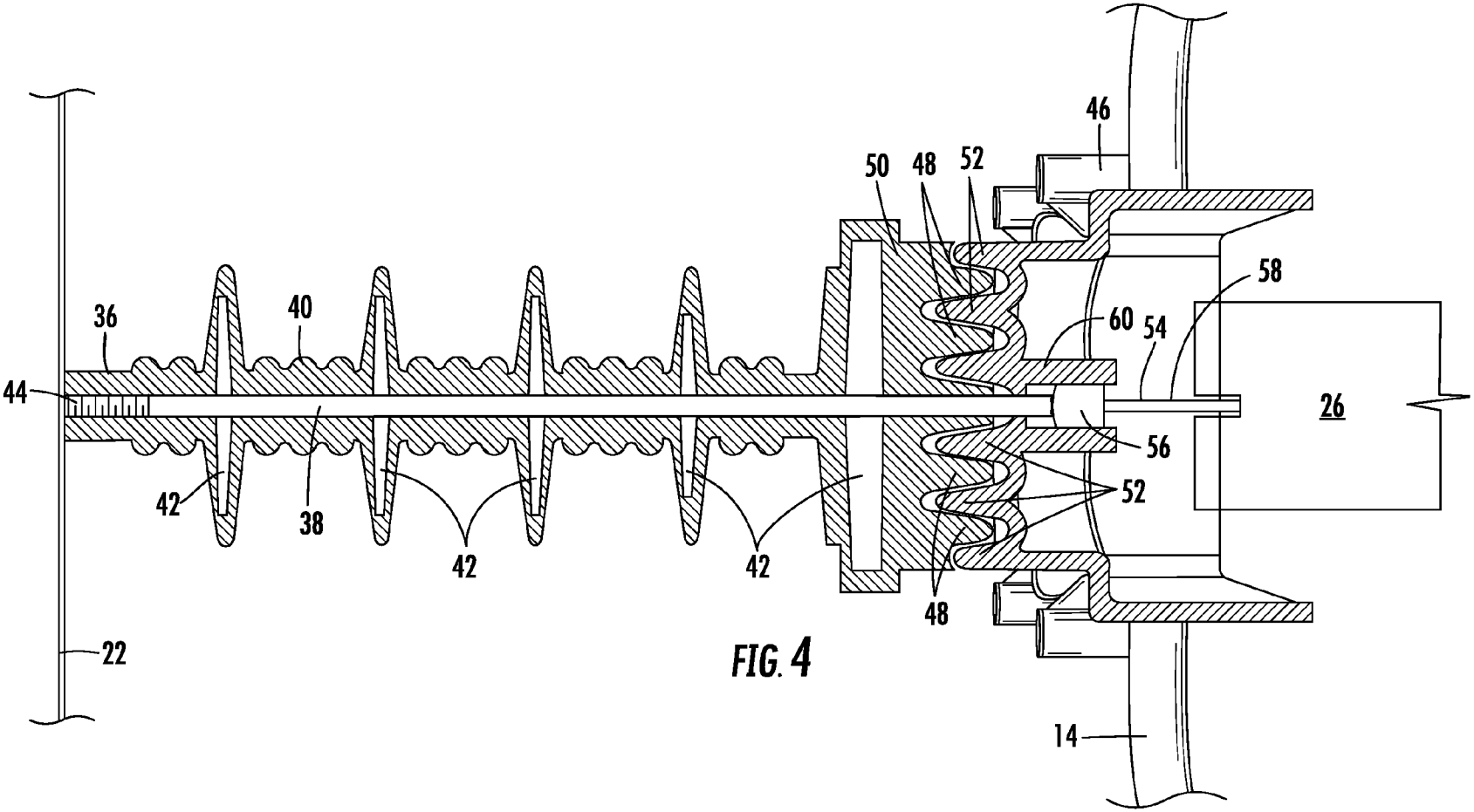
FIG. 4 is a cross-sectional view of an embodiment of an electrode support.

Referring to FIG. 3, the ionization array 22 is positioned and retained in the frame 14 by one or more electrode supports 36. As shown, some embodiments include four electrode supports 36, but it is to be appreciated that other numbers of electrode supports 36, for example, two or three electrode supports 36, may be utilized. At least one of the electrode supports 36 deliver electrical power to the ionization array 22, rather than the system 10 utilizing a separate power connection to the ionization array 22 as in the prior art. Referring now to FIG. 4, to deliver electrical power to the ionization array 22, the electrode support 36 includes a conductor 38, which in some embodiments is a metal rod, extending through the electrode support 36 and electrically connected to the ionization array 22 and to the power supply 26.

In some embodiments, the conductor 38 is at least partially encapsulated in an insulative layer 40 or, for example, silicone or EPDM rubber. The use of a silicone or similar material improves the insulation performance of the electrode support 36, especially in wet conditions. Further the electrode support 36 may include a number of sheds 42 arranged along an axial length of the electrode support 36, and extending radially outwardly therefrom. The sheds 42 create a long tracking path for current leak off from the ionization array 22, thereby improving insulation of the ionization array 22 even in wet or dirty conditions. The sheds 42 may be constructed of the same material, for example silicone, as the rest of the body of the electrode support 36, or they may alternatively contain internal support discs of another more rigid material such as a hard plastic, or other substantially non-conductive material. The sheds 42 may further be formed in a variety of suitable shapes, for example, circular discs as shown, and/or include spokes, waves and/or undulations to further lengthen the tracking path.

Figure 5:
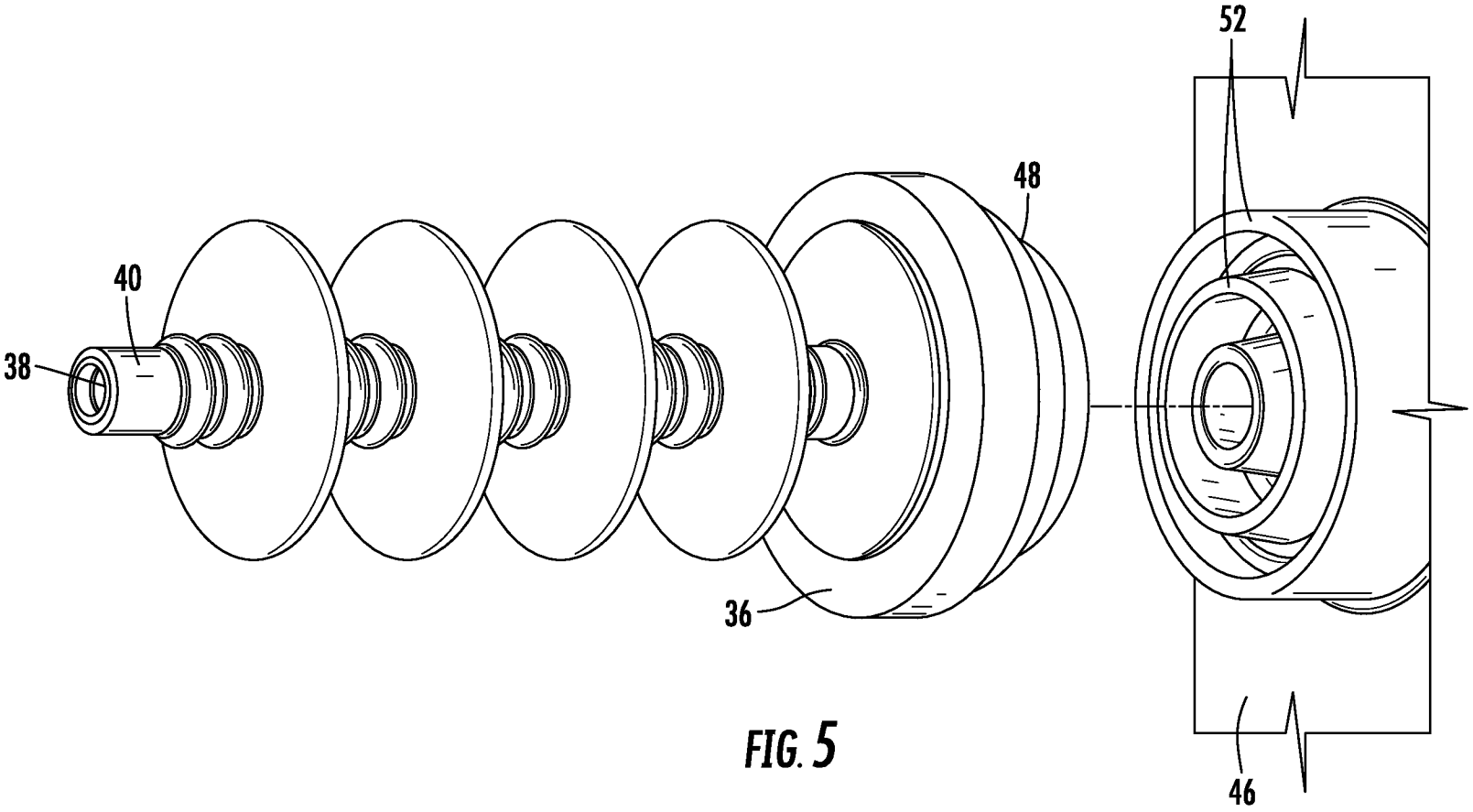
FIG. 5 is a perspective view of an embodiment of an electrode support.

The conductor 38 is electrically connected to the ionization array 22 by, for example, a screw 44 or other connection means. In some embodiments, the electrode support 36 is secured at the frame 14 via a connector 46 disposed at the frame 14. In some embodiments, the connector 46 is formed of a hard plastic material, and is secured to the frame 14 via a suitable means, such as one or more clamps or mechanical fasteners (not shown). In other embodiments, the connector 46 is secured to the frame 14 by a press fit in an opening in the frame 14, or other means. As shown, the electrode support 36 may include a plurality of support ribs 48 extending from a support base 50. The support ribs 48 mesh with a plurality of complimentary connector ribs 52 at the connector 46 to create a long path length and resist electrical tracking on the surface of the connector 46. In some embodiments, the support ribs 48 and/or the connector ribs 52 may be tapered along their length to act as guides for assembly and/or connector 46 closure. In some embodiments, as shown in FIG. 5, the connector ribs 52 are a number of concentric rings which engage with complimentary ring-shaped support ribs 48. Even though ring-shaped connector ribs 52 are shown in FIG. 5, it is to be appreciated that that shape is merely exemplary and that other shapes, for example, hexagonal, oval, elliptical or the like may be used. In some embodiments, the support ribs 48 are formed from a soft plastic material such as silicone. Thus, when the support ribs 48 engage with the connector ribs 52, the support ribs 48 conform to the space between the connector ribs 52 and provide a seal to keep contaminants such as moisture and dirt out of the connection. In other embodiments the outer ring on either of the mating annular ribbed surfaces may be slightly taller than the inner rings, thereby producing a seal to keep contaminants and moistures out away from the inner ribs.

Referring again to FIG. 4, in some embodiments, the connector 46 includes an intermediate connector 54 to connect the conductor 38 to the power supply 26 when the electrode support 36 is secured to the insulator 46. The intermediate connector 54 includes a plunger 56 which is biased by a spring 58 into an insulator opening 60 and electrically connected to the power supply 26. When the electrode support 36 is installed at the connector 46, the spring-loaded plunger 56 in opening 60 maintains positive contact with conductor 38.

In some embodiments, the connector 46 is part of a removable assembly, for example, an access door 72 of the system 10 that contains the power supply 26. This allows for quick and easy removal of the connector 46 and power supply 26 so that the frame 14 and remainder of the system 10 may be easily cleaned, with water if desired.

Connecting the power supply 26 to the ionization array 22 via the conductor 38 in the electrode support 36 eliminates the need for a separate connection arrangement of the power supply 26 to the ionization array 22. Elimination of the separate connection reduces potential points for current leak-off from the ionization array 22.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electrode support for an electrode of an electrically-enhanced air filtration system comprising:

a conductor extending through the electrode support and electrically connectible to the electrode and to a power supply;

an insulative layer disposed around the conductor;

the electrode support configured to position the electrode in a frame of the air filtration system; and a plurality of support ribs configured to engage with a plurality of connector ribs disposed at one of the frame or an access door to create a an electrical connection with a surrounding connector having a long path length, the plurality of support ribs arranged as a plurality of concentric rings configured to engage with the plurality of connector ribs arranged as a plurality of concentric rings.

2. The electrode support of claim 1, wherein the electrode support includes one or more sheds extending radially outwardly from a central axis of the electrode support.

3. The electrode support of claim 2, wherein the one or more sheds include one or more of spokes, waves or undulations.

4. The electrode support of claim 1, wherein the conductor is electrically connectible to the electrode via a mechanical fastener.

5. The electrode support of claim 1, wherein the conductor is electrically connectible to the power supply via a spring-loaded plunger connection.

6. An air filtration system comprising:

a frame directing an airflow through the air filtration system; and an electrode disposed in the frame;

an electrode support to position the electrode in the frame including:

a conductor extending through the electrode support and electrically connected to the electrode;

an insulative layer disposed around the conductor; and a plurality of support ribs configured to engage with a plurality of connector ribs disposed at one of the frame or an access door to create a an electrical connection with a surrounding connector having a long path length, the plurality of support ribs arranged as a plurality of concentric rings configured to engage with the plurality of connector ribs arranged as a plurality of concentric rings; and an electrical power supply electrically connected to the conductor to provide electrical power to the electrode.

7. The air filtration system of claim 6, wherein the plurality of connector ribs are disposed at a connector secured to the frame.

8. The air filtration system of claim 7, wherein the connector is formed from one of silicone or EPDM rubber.

9. The air filtration system of claim 6, wherein the one or more of the plurality of connector ribs and the plurality of support ribs are tapered along their length.

10. The air filtration system of claim 6, wherein the plurality of support ribs and the plurality of connector ribs form a seal therebetween.

11. The air filtration system of claim 10, wherein the seal is formed between an outermost support rib of the plurality of support ribs and an outermost connector rib of the plurality of connector ribs.

12. The air filtration system of claim 6 including a spring-loaded plunger electrical connection between the electrode and the power supply.

13. The air filtration system of claim 6, wherein the electrode support includes one or more sheds extending radially outwardly from a central axis of the electrode support.

14. The air filtration system of claim 13, wherein the one or more sheds include one or more of spokes, waves or undulations.

15. The air filtration system of claim 6, wherein the conductor is electrically connectible to the electrode via a mechanical fastener.

* * * * *